US009719654B2

(12) United States Patent
Chien

(10) Patent No.: US 9,719,654 B2
(45) Date of Patent: Aug. 1, 2017

(54) LED AND/OR LASER LIGHT HAS MORE THAN ONE OPTICS MEANS TO CREATE WIDER OR BIG AREAS IMAGE

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 14/503,647

(22) Filed: Oct. 1, 2014

(65) Prior Publication Data

US 2015/0211701 A1 Jul. 30, 2015

Related U.S. Application Data

(63) Continuation-in-part of application No. 14/023,889, filed on Sep. 11, 2013.

(51) Int. Cl.

| | |
|---|---|
| ***F21S 10/02*** | (2006.01) |
| ***F21V 5/00*** | (2015.01) |
| ***F21V 7/00*** | (2006.01) |
| ***F21S 8/00*** | (2006.01) |
| ***F21S 6/00*** | (2006.01) |
| ***F21V 21/14*** | (2006.01) |
| ***F21V 23/04*** | (2006.01) |
| ***F21S 10/06*** | (2006.01) |
| ***F21K 9/60*** | (2016.01) |
| *F21S 9/02* | (2006.01) |
| *F21Y 113/10* | (2016.01) |
| *F21Y 115/10* | (2016.01) |

(52) U.S. Cl.

CPC ..... *F21V 5/00* (2013.01); *F21K 9/60* (2016.08); *F21S 6/002* (2013.01); *F21S 8/035* (2013.01); *F21S 10/023* (2013.01); *F21S 10/063* (2013.01); *F21V 7/00* (2013.01); *F21V 21/14* (2013.01); *F21V 23/0442* (2013.01); *F21S 9/02* (2013.01); *F21Y 2113/10* (2016.08); *F21Y 2115/10* (2016.08)

(58) Field of Classification Search

CPC ..... F21S 10/02; F21S 8/035; F21K 9/50

See application file for complete search history.

(56) References Cited

U.S. PATENT DOCUMENTS

2006/0152946 A1* 7/2006 Chien ..... 362/641

* cited by examiner

*Primary Examiner* — Elmito Breval

(74) *Attorney, Agent, or Firm* — Bacon & Thomas, PLLC

(57) ABSTRACT

An LED and/or laser light device for having a plug-in power source, an interchangeable power source, or a USB power source incorporates more than one optical element having more than one reflective or refractive surfaces at different positions, distances, and/or orientations relative to the LEDs and/or laser-light source of the LED or laser light to cause light beams to reflect or refract before passing through the optical elements and create or project an image, message, time, geometric art, nature scene, galaxy, milky way, sky, cloud, start, moon, water-wave, aurora light, animal, characters, cartoon, sign, logo, commercial to at least one surface surrounding the light device. The optical elements may have a predetermined texture and/or shaped openings, windows, cutouts, or variable thicknesses and further may incorporate parts and accessories such as a motor to provide moving image effects with a wide viewing angle and variable colors or patterns.

10 Claims, 10 Drawing Sheets

Fig 1C
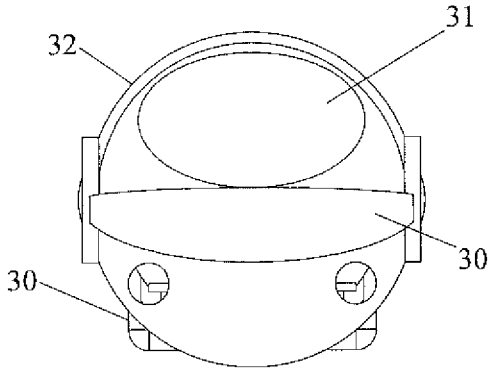
Fig 1D
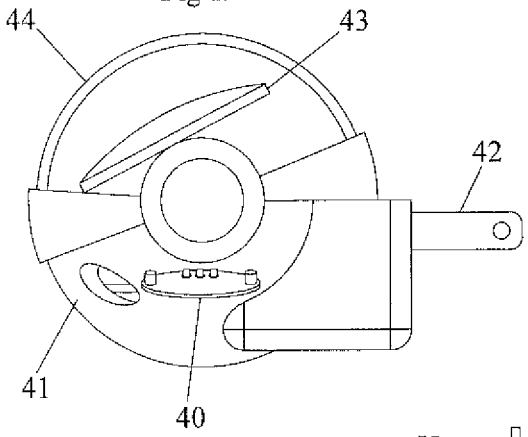
Fig 1E
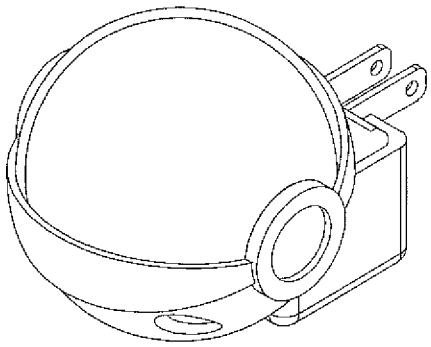
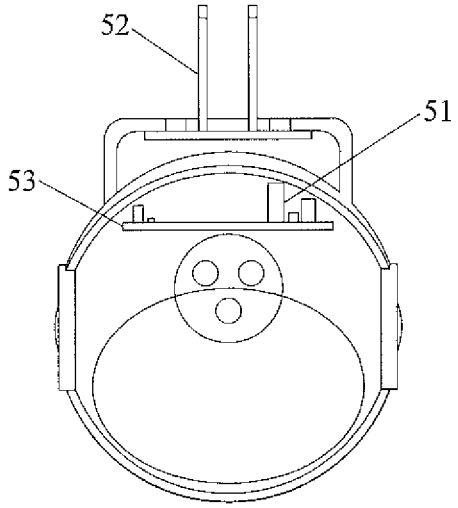
Fig 1F

Fig 2
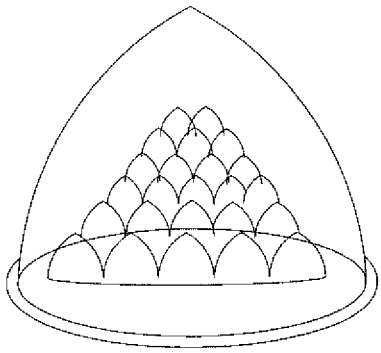
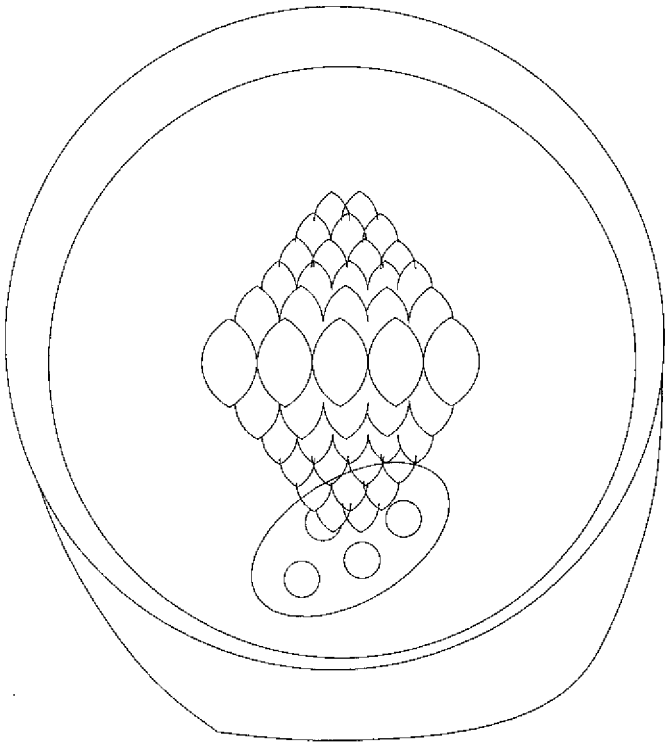
Fig 2A

LED AND/OR LASER LIGHT HAS MORE THAN ONE OPTICS MEANS TO CREATE WIDER OR BIG AREAS IMAGE

BACKGROUND OF THE INVENTION

A lot of bulky desk top devices having some optics means and noisy motor means to get images to the walls or ceiling are available in the marketplace. None of these devices have a compact size, light weight, or low cost.

According to one embodiment of the current invention, an improved LED and/or laser-light device provided for displaying a desired image, message, time, geometric art, nature scene, galaxy, milky way, sky, cloud, stars, moon, water-wave, aurora light, animal, characters, cartoon, sign, logo, or commercial on a desired surface and which has a compact size with light weight to allow people to achieve plug-in installation to any outlet device, such as a wall outlet, extension cord, power strip, outlet device, or a USB power source.

A plug-in outlet or USB port allows easy connection with a power source without the disadvantages of an AC wired connection, an adaptor with a wired connection, or a transformer with a wire device, in which the wires are very difficult to handle and may cause people to fall down or be damaged to cause electric-shock. As a result, the current invention preferably does not use a wired power source which will cause the consumer to fall down and which are also too risky for desk top installation, and instead preferably is arranged to be plugged into an outlet or USB port without having to be wired thereto.

In addition, the plug-in outlet or USB port serves as an unlimited power source, unlike market-available models which are battery operated for desk top applications and which as a result require frequent change of battery to supply enough electricity for a plurality of LEDs or/and laser-light(s), which may need hundreds of milliamps of current to per hour.

Consequently, the current invention, which is arranged to be plugged into outlets or USB ports, represents a big improvement over market-available desk top LED or laser light devices with wired connections or battery units.

According to a second embodiment of the current invention, traditional skills are used to provide a motor, a rotating magnetic and magnetic-coil means, or a cheap and silent clock movement that causes moving effects in the form of a moving optic-means or moving light source(s). The moving optic-means may incorporate other optics-means to enhance the performance of the LED(s) or/and laser-light(s) in providing effects or functions such as color change, size change, motion, moving images and other light functions or effects available from the marketplace, including combinations thereof. Some preferred embodiments described below may have three, four, or five optics means to form a splendid light show.

According to a third preferred embodiment, the current invention may use an alternative design to create moving effects without the need to use a motor, or rotating magnetic and magnetic-coil means, in order to reduce costs, i.e., the LED and/or laser-light does not use any motor means to create the changeable image, message, time, geometric art, nature scene, galaxy, milky way, sky, cloud, stars, moon, water waves, animal, characters, cartoon, sign, logo, commercial.

According to a fourth preferred embodiment, a big improvement provided by the current invention is to have all moving or motion effects made by a plurality of LEDs' sequential flashing, fade-in and fade-out, color changing, sequential, random, or other LED light performances or effects by turning individual LEDs on and off with a time difference, duration, or duty cycle and cause the resulting image to appear as if it were moving.

According to a fifth preferred embodiment, a more advanced improvement is to generate a shaped image, message, time, geometric art, nature scene, galaxy, milky way, sky, cloud, stars, moon, water-wave, aurora light, animal, characters, cartoon, sign, logo, or commercial from at least one or more optics means having a preferred texture, opening, cutouts, holes, or shape and a steady LED and/or laser-lights' beam with rotating or non-rotating means.

The preferred embodiments of the current invention may utilize features disclosed in the inventor's U.S. patent appl. Ser. No. 14/023,889, filed Sep. 11, 2013; Ser. No. 14/323,318; filed on Jun. 26, 2014 and Ser. No. 12/938,564, filed Nov. 2, 2014; and U.S. Pat. No. 7,455,444 (more than one LED light source); U.S. Pat. No. 7,632,004 (more than one optic means); and U.S. Pat. No. 8,277,087 (more than one reflective means to create multiple visible image).

The current has subject matter in common with the inventor's following applications: U.S. patent appl. Ser. No. 14/024,229 (LED light has kaleidoscope means); Ser. No. 13/021,124 (LED light having changeable image and pattern by kaleidoscope means to project to surfaces); Ser. No. 12/710,918 (LED light having more than one reflector means), now U.S. Pat. No. 8,277,087, the arrangement of which may be utilized in the current by providing a kaleidoscope means having more than one reflective means that uses a mirror or mirror-like means assembled into the kaleidoscope means; Ser. No. 11/806,284 (LED light having more than one optic means), now U.S. Pat. No. 7,632,004, which discloses an arrangement that may be utilized by the current invention by applying the more than one optics means in front of or in back of back of a kaleidoscope means to create, adjust, magnify, reduce, or enlarge an image, LED light beams, or an LED lights' shape, the optics means including any combination of an optics lens, optics mirror, laser hologram, laser grating film, or optics assembly.

The inventor's U.S. Pat. No. 7,455,444 discloses an LED light having more than one LED light source, the current invention also capable of utilizing more than one LED in a matrix arrangement with circuit means, IC means, sensor means, switch means, brightness control means, color mixing means, color selection means, color freeze means, motor means, gear means, and turn-on/turn-off means to cause a certain number of LEDs to be turned-on with desired colors, brightness, light brightness output, light functions, matrix combinations, motor means, rotating means, and/or gear set means to cause light to pass through the kaleidoscope means and optics means to achieve desired light patterns.

Other U.S. patent applications of the inventor include U.S. patent application Ser. Nos. 12/948,953; 12/938,564; 12/886,832; 12/876,507 [12/771,003; 12/624,621; 12/914,584; 12/318,471; 12/318,470; and Ser. No. 12/834,435; 12/292,153 (now U.S. Pat. No. 7,871,192); Ser. No. 12/232,505 (now U.S. Pat. No. 7,832,917); and Ser. No. 12/318,473 (now U.S. Pat. No. 7,832,918). Additional patent applications of the inventor that disclose projection lights include U.S. Patent Appl. Ser. No. 12/624,621 (now U.S. Pat. No. 8,303,150); Ser. No. 12/771,003 (now U.S. Pat. No. 8,408,736); Ser. No. 12/876,507 (now U.S. Pat. No. 8,083,377); Ser. Nos. 12/886,832; 12/938,564; 12/948,953; and Ser. No. 13/021,107.

Furthermore the inventor also has copending U.S. patent applications for light devices having interchangeable power sources for AC wall outlets and DC energy storage means, including all kinds of combinations selected from prong means, extension cords, adaptors, transformers, solar or wind power, batteries, chemical power, and biological power, all of which can be interchanged to provide AC or battery power in any desk top or plug in type projection light device having a built-in kaleidoscope means. The inventor's interchangeable power source applications U.S. patent application Ser. Nos. 12/318,473 and 12/940,255 (now U.S. Pat. No. 8,231,246).

The current invention thus may utilizes principles and structures from a variety of the inventor's patents or copending patent applications, such as: (1) a projection light device; (2) more than 1 optics means; (3) more than 1 LED; (4) more than 1 reflective means; (5) interchangeable power sources; (6) laser means; (7) adjustable focus and position changing; and (8) use of a motor and gear set for image adjustment and moving.

This application also has subject matter in common with U.S. patent application Ser. Nos. 12/710,561; 12/711,456; 12/771,003; 12/624,621; 12/622,100; 12/318,471; 12/318,470; 12/318,473; 12/292,153; 12/232,505; 12/232,035; 12/149,963; 12/149,964; 12/073,095; 12/073,889; 12/007,076; 12/003,691; 12/003,809; 11/806,711; 11/806,285; 11/806,284; 11/566,322; 11/527,628; 11/527,629; 11/498,874; 12/545,992; 12/806,711; 12/806,285; 12/806,284; 12/566,322; 12/527,628; 12/527,629; 12/527,631; 12/502,661; 11/498,881; 11/255,981; 11/184,771; 11/152,063; 11/094,215; 11/092,742; 11/092,741; 11/094,156; 11/094,155; 10/954,189; 10/902,123, 10/883,719; 10/883,747; 10/341,519; 12/545,992; and 12/292,580.

In particular, the following applications show light devices that have at least some features in common with included or optional features of the LED light device of the present invention: Ser. No. 12/710,561 ("LED power failure Light"); Ser. No. 12/711,456 ("LED light device has special effects"); Ser. No. 12/771,003 ("LED light device has more than 1 reflective means for plurality of image"); Ser. No. 12/624,621 ("projection device or assembly for variety of LED light"); Ser. No. 12/622,000 ("Interchangeable Universal Kits for all LED light"); Ser. No. 12/318,471 ("LED night light with pinhole imaging"); Ser. No. 12/318,470 ("LED night light with Projection features"); Ser. No. 12/318,473 ("LED night light with laser or hologram element"); Ser. No. 12/292,153 ("LED night light with Projection or imaging features"); Ser. No. 12/232,505 ("LED night light with Projection features"); Ser. No. 12/149,963 ("Removable LED light device"); Ser. No. 12/149,964 ("Surface Mounted Device with LED light"); Ser. No. 12/073,095 ("LED Track light device"); Ser. No. 12/073,889 ("LED light with changeable position with Preferable power source"); Ser. No. 12/007,076 ("LED light with changeable geometric system"); Ser. No. 12/003,691 ("LED light with changeable geometric dimension features"); Ser. No. 12/003,809 ("LED light with changeable features"); Ser. No. 11/806,711 ("Multiple LED light with adjustable angle features"); Ser. No. 11/806,285 ("LED Night light with outlet device"); Ser. No. 11/806,284 ("LED Night light with more than 1 optics means"); Ser. No. 11/527,628 ("Multiple function Night light with air freshener"); Ser. No. 11/527,629 ("LED Night light with interchangeable display unit"); Ser. No. 11/498,874 ("Area illumination Night light"); Ser. No. 11/527,631 ("LED Time piece night light"); Ser. No. 12/545,992 ("LED time piece Night light"); Ser. No. 12/292,580 ("LED Time Piece Night light"); Ser. No. 11/498,881 ("Poly Night light"); Ser. No. 11/255,981 ("Multiple light source Night Light"); Ser. No. 11/184,771 ("Light Device with EL elements"); Ser. No. 11/152,063 ("Outlet adaptor with EL"); Ser. No. 11/094,215 ("LED night light with liquid medium"); Ser. No. 11/094,215 ("LED Night light with Liquid optics medium"); Ser. No. 11/092,741 ("Night light with fiber optics"); Ser. No. 10/883,747 ("Fiber Optic light kits for footwear"); Ser. No. 11/498,874 ("Area Illumination for LED night light"); Ser. No. 11/527,629 ("Time Piece with LED night light"); Ser. No. 11/527,628 ("Multiple Function Night light with Air Freshener"); Ser. No. 11/806,284 ("LED Night light with more than one optics mediums"); Ser. No. 11/806,285 ("LED Night Light with multiple function"); and Ser. No. 11/806,711 ("Multiple LEDs Light with adjustable angle function").

A preferred embodiment of the current invention includes an LED or laser light has more than one optics means, each of the optics means having light transmitting, reflective, and/or refractive means within the geometric shape of the optics means to enable a plurality of LED or laser light beams to pass through, reflect, and/or refract.

The LED(s) and/or laser light device includes at least one LED and/or laser arranged inside a geometric optics means having more than one reflective and/or refractive means, and at least one second reflective and/or refractive means within the geometric optics means which can reflect or refract LED and/or laser light beams from its surface to the first or other reflective or refractive surfaces back and forth so that some light beams are reflected or refracted and travel within the optics means and other light beams pass through a partially transparent optics means to the outside.

In some preferred embodiments, a plurality of the light beams emitted by the LED(s) and/or laser-lights can travel or pass through an outside wider opening with a wide viewing angle that enables viewing of multiple surfaces. Furthermore, at least one of the reflective and/or refractive means may be partially transparent so that a plurality of light beams pass through from the surfaces thereof, while another plurality of the light beams is reflected, retro-reflected, or refracted within another reflector and refractive means and passes through some other location of the optics means.

The LEDs and/or laser-lights of these embodiments are preferably connected with circuit means, power means, contact means, conductive means, switch means, sensor means, motor means, movement means, magnetic unit and coil means, spin means, rotating means, gear set means, speed control means, printed circuit means, integrated circuit (I.C.) means and/or related parts and accessories to cause the LEDs and/or laser-light(s) to turn on and off according to a predetermined time period, functions, colors, and/or effects to provide a desired lighting performance.

In the above-described preferred embodiment, the reflective and/or refractive means may be a mirror-like polished surface, optics lens, convex lens, concave lens, optics properties lens, chrome finished piece, polished piece, double-sided mirror, or any surface having a desired size, shape, thickness, focus, or wide viewing angle and which has reflective or refractive properties and lets light beams to travel or pass through both or more than one of the optics means of the current invention.

The partially transparent or see-though properties and reflective or refractive features can be provided by a transparent piece, colored transparent piece, or any other piece that allows light beams to pass therethrough or be reflected or refracted. A power source of those embodiments can be in the form of an outlet, batteries, solar power, chemical power, or wind power achieved by proper connection means such as a prong or USB means.

The LEDs and/or laser-lights can be selected from any combination of single color, multiple color, multiple piece, standard, and special assemblies. The LEDs and/or lasers can be number from 1 to N (N can be any number) arranged in a desired matrix, order, or combination with proper spacing.

Finally, the distance, position, and/or orientation of the reflective or refractive means may be changed based on the selected geometric shape of the optics means relative to the LED(s) or laser-light(s). The LED or laser-light arrangement for different LED or laser-light numbers, positions, colors, IC chip, control means, circuit means, functions, and brightness may be selected to incorporate a motor/movement/spin/rotating/magnetic unit and coil means to create a desired plurality of light patterns, shows, color changing, image changing, or moving effects to be seen by people on surrounding surfaces including walls, a ceiling, a floor, or any other desired surface(s).

The geometric optics means can have any shape with multiple constructions and combination of elements selected from a light transmitting lens, reflective lens, convex lens, concave lens, laser lens, and hologram lens having a desired focus, thickness, variable thickness, plurality of optics means, wave texture, desired texture, curvature, curve, or optics properties on an inner or outside surface or on all sides to provide desired light effects.

As noted above, the current invention uses more than one geometric shape of optics-means having built-in more than one reflective or refraction means to create a plurality of LED and/or laser light beams that pass through or are reflected, retro-reflected, or refracted by the more than one optics means and that may be selected to incorporate other electric parts and accessories to get a wider viewing angle. The relative distance, position, and/or orientation of the more than one optics means relative to the light source (and optional additional) reflective and/or refractive means will result in different light beam performance. This is a very low cost and simple way to make a splendid and eye catching light performance unit with wider viewing angle to cover wide area images for people, and which may incorporate any desired power source such as a battery, USB power, outlet power, generator power, chemical power, solar power, wind power or another equivalent power source from the marketplace.

BRIEF DESCRIPTION OF THE DRAWINGS

FIGS. 2 and 2A show two preferred embodiments of the current invention's optic means having: (1) plenty of different optics units built into one piece, the plenty of optics units having different sizes, shapes, geometric shapes, thicknesses, focuses, reflective properties, or refractive properties to cause the LED or laser light beams to travel or pass through the optics units and provide splendid and predesigned light beam patterns, colors, distributions, shapes, brightnesses, and other light effects, performance, or functions and which may incorporate motor/movement/spin/rotating/magnetic unit and coil means to cause the optic means to become a moving optics means. FIG. 2A shows the more than one optics means on the top of the light source (LEDs and laser-lights) with both light source light beams hitting the center of a crystal-like optics ball, and some of the light traveling and passing though the crystal-like optics ball based on reflective or refraction theory so as to create very eye-catching light effects. Both optics means can cooperate with a motor/moving/spin/rotating/magnetic unit and coil means to provide a moving optics means and moving reflective lens to get the desired light effects.

FIGS. 1C, 1D, 1E, and 1F show a preferred embodiment of the current invention having two optics means, one of which is a top cover and one of which is an inner disc-like convex lens, both optics means having preferred wave-textures with a variable thickness so that the LEDs or laser-lights, some of the light beams passing through the disc-like convex lens wave textures to generate a first image and all first image generating beams traveling or passing through a second big and wide optics-means to create the a super large size viewing angle image, message, time, geometric art, nature scene, galaxy, milky way, sky, cloud, stars, moon, water waves, animal, characters, cartoon, sign, logo, or commercial.

DETAILED DESCRIPTION OF THE PREFERRED EMBODIMENTS

Figure 1:
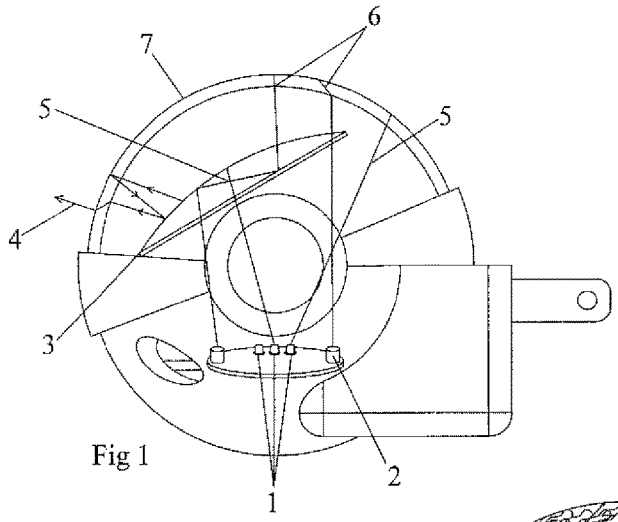
FIGS. 1, 1A, and 1B show three preferred embodiments of the current invention having prong means and more than one optic means to create wide viewing angle images. All of these embodiments have common parts including (1) a light source-LED(s) or laser-light(s) (2) a wider angle top cover with its preferred optic properties (3) more than one optics means including at least one inner optics means having plenty of reflective or refractive means built-in (4) each optics means having predetermined optics properties determined by making the optics means having different sizes, shapes, thicknesses, variable thicknesses, heights, assortments, arrangements, combinations and geometries (5) the optics means or light source (LEDs and/or laser-light) optionally being incorporated with motor/spin/rotating/motion/magnetic unit and coil means to cause the optical means or light source to become a moving optical means or moving light source, resulting in a splendid light performance having a changeable image, message, time, geometric art, nature scene, galaxy, milky way, sky, cloud, stars, moon, water waves, animal, characters, cartoon, sign, logo, or commercial.
Figure 1A:
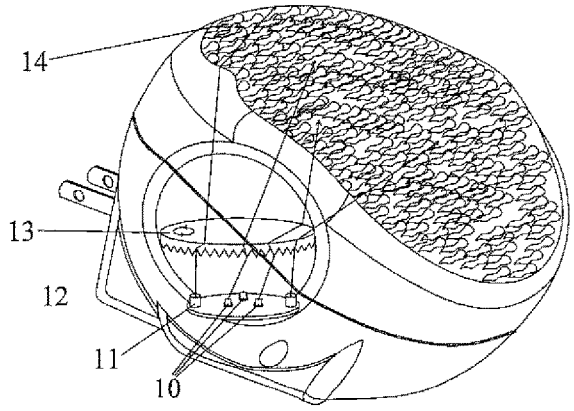
Figure 1B:
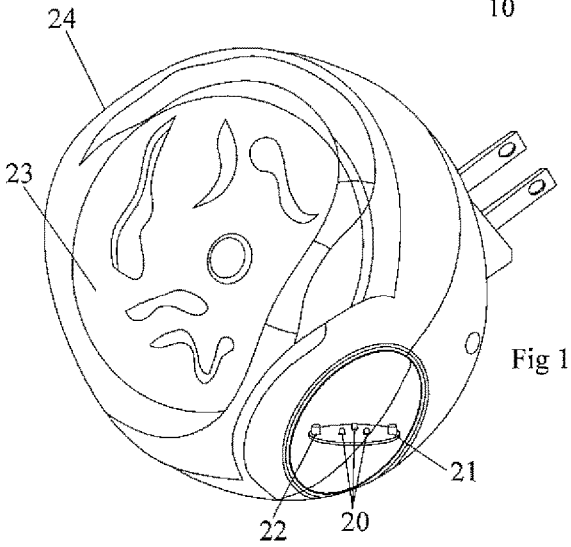

FIGS. 1, 1A, and 1B show an LED or laser-light device having more than one optic-means with reflective or refractive means for a plug-in type device having prong means to connect with a wall outlet, extension cord, power station, or desk lamp outlet receptacle. The LED or laser-light device creates a light image on a ceiling, wall, or floor as a result of a more than one optics-means construction and has a top cover which includes the first optics means and which has a wide and big size to let all light beams from the light source spread out to a wider and bigger space, area, or location.

The optics-means may include more than one optics lens having convex, reflective or refractive properties, or any combination of these properties based on requirements. The current invention uses the more than one geometric shape of optics-means to cause light beams emitted out from an LED or laser-lights' head to hit a first reflective or refractive-means, and then hit second, third, fourth, etc. optics means until the light beams pass through to the outside of a top optics cover means.

As shown in FIG. 1, the more than one optics means includes the top cover 7 with a first optics means and the second, inner optics means 3. The top cover 7 has textures or a variety of reflective and/or refractive lens designs to cause all incoming light beam to reflectively and/or refractively travel or pass through the top cover to the viewer. The light beams 5 or 6 emitted from below by the LEDs 1 or laser-light(s) 2 provide very splendid color, light sport, diffusion, and variable pattern effects when incorporated with an IC, movement means, or motion means.

FIG. 1-A shows more than one optics means 13 and 14, not only including the top cover with textures such as wave textures, but also an inner second optics means 13 which is movable, shakable, waving, rotating, or spinning so as to cause light beams from the non-movable light source including LEDs 10 and/or laser-lights 11 to pass through the movable second optics means 13 and its optics designs such as textures or a plurality of wave shaped optics lens multiple times due to reflection and/or refraction before passing through the top cover optics means. The input light beams hit the first top cover optics means 14 and its texture or optics designs will cause multiple times reflection and/or refraction to cause motion wave effects or effects such as an aurora, moving clouds, changeable galaxy, moving stars, moving milky river or other nature scene that can be produced by the above design.

FIG. 1B shows a moving second optics means 23 which incorporates a third optics means 25 having a plurality of tiny optics lenses with different sizes, shapes, geometries, thicknesses, focus, and/or colors and which may be incorporated with motor means, spin means, rotating means, movement means, magnetic unit and coil means, shaking means, waving means, and crank means to cause light beams from the fixed LEDs 20 or laser-lights 21,22 to travel and pass through the lower third optical means 25 and second moving optics 23 with shaped holes, windows, cutouts, or opening means and achieve a desired shaped or effect such as an aurora light shape, cloud shape, star shape, milky river, or galaxy shape before the light beams hit the first cover optic means 24 to enlarge and spread out the light beams to obtain a wider viewing angle image visible to viewers.

These three detailed drawings all show light beams emitted out from the lower position's LEDs or laser-light and then traveling and/or passing through different second or third optic means to cause some of the plurality of light beams or shaped light beams to hit the cover optics means, which provides a very good design with effects that cannot achieved by a single optics means.

The current invention can use a variety of optics means, including:

(1) optic means having textures;
(2) optics means having shaped holes, openings, cutouts, windows, or stencils;
(3) moving optic means incorporating crank means, motor means, spin means, rotating means, movement means, or magnetic unit and coil means;
(4) optic means having a plurality of different shapes, sizes, colors, thicknesses, or variable thicknesses in one piece to enable light beams from the fixed LEDs or laser-light to become very splendid and spread out light beams;
(5) optic means for a cover which has wide openings so as to provide a wider viewing angle and cause all light beams to spread out to wider and bigger areas
(6) optics means having any shape such as a sheet, piece, ball, half ball, bar, cover, or any other geometric shape with a preferred optical construction including texture, openings, windows, a convex lens, a magnifying lens, variable thicknesses, and variable focus by a plurality of tiny optic means, reflective means, or refraction means with added steady, fixed, moving, waving, shaking, vibration, or rotating features.

As shown in FIGS. 1, 1A, and FIG. 1B, the cover optics-means and inner second or third optics means cause the light beams from the LEDs and/or laser-light to create a splendid color image in all surrounding areas. The LEDs and/or laser-light(s) may have any desired color, specifications, size, functions, power, or watts, and each LED and/or laser-light(s) can have its own emitting direction, orientation, or angle in any direction because the inner surface of the optics-means has more than one reflecting-means so that even though the light emitting angle may be narrow, after the light beam has been reflected and/or refracted, the light will come out all over the device and in particular come out from the wider viewing angle top cover or desired sides as a result of using (1) more than one LEDs or laser-light(s), (2) more than one reflecting or refracting means, and/or (3) more than one optics-means with desired optic properties, and by (4) selected or incorporating other parts and accessories such as a motor means, movement means, magnetic unit and coil means, interchangeable power sources, moving optics means, light-blocking means with shaped holes, openings, or windows, a textured lens, an optics lens, a plurality of optics lens, IC means, power source means, and so forth, including the parts and accessories described in the inventor's U.S. patent application Ser. Nos. 12/318,471; 12/318, 470; 12/834,435; 12/292,153 (now U.S. Pat. No. 7,871,192); Ser. No. 12/232,505 (now U.S. Pat. No. 7,832,917); Ser. No. 12/318,473 (now U.S. Pat. No. 7,832,918); Ser. No. 12/624,621 (now U.S. Pat. No. 8,303,150); Ser. No. 12/771,003 (now U.S. Pat. No. 8,408,736); Ser. No. 12/876,507 (now U.S. Pat. No. 8,083,377); Ser. No. 12/886,832; 12/938,564; 12/948,953; and Ser. No. 13/021,107.

FIGS. 1C to 1G show an alternating current (AC) power unit which has an AC adaptor, transformer, and AC wires to enable the LED projection light to have a splendid projection light image. As shown in FIG. 1C, the light device may include a wide-angle spherical outside optics means 32 and an inner optics lens 31 supported by a base 30. As shown in FIGS. 1D and 1E, the light device may include the wide-angle spherical outside optics means (numbered as element 44 in this figure), an inner optics lens 43, prong means 42, and LEDs 40 situated in base 41. The light device as shown in FIG. 1F also includes main printed circuit board 53 on which are mounted an IC and electric parts and accessories 51, as well as LEDs 50 and prong means 52.

Figure 1G:
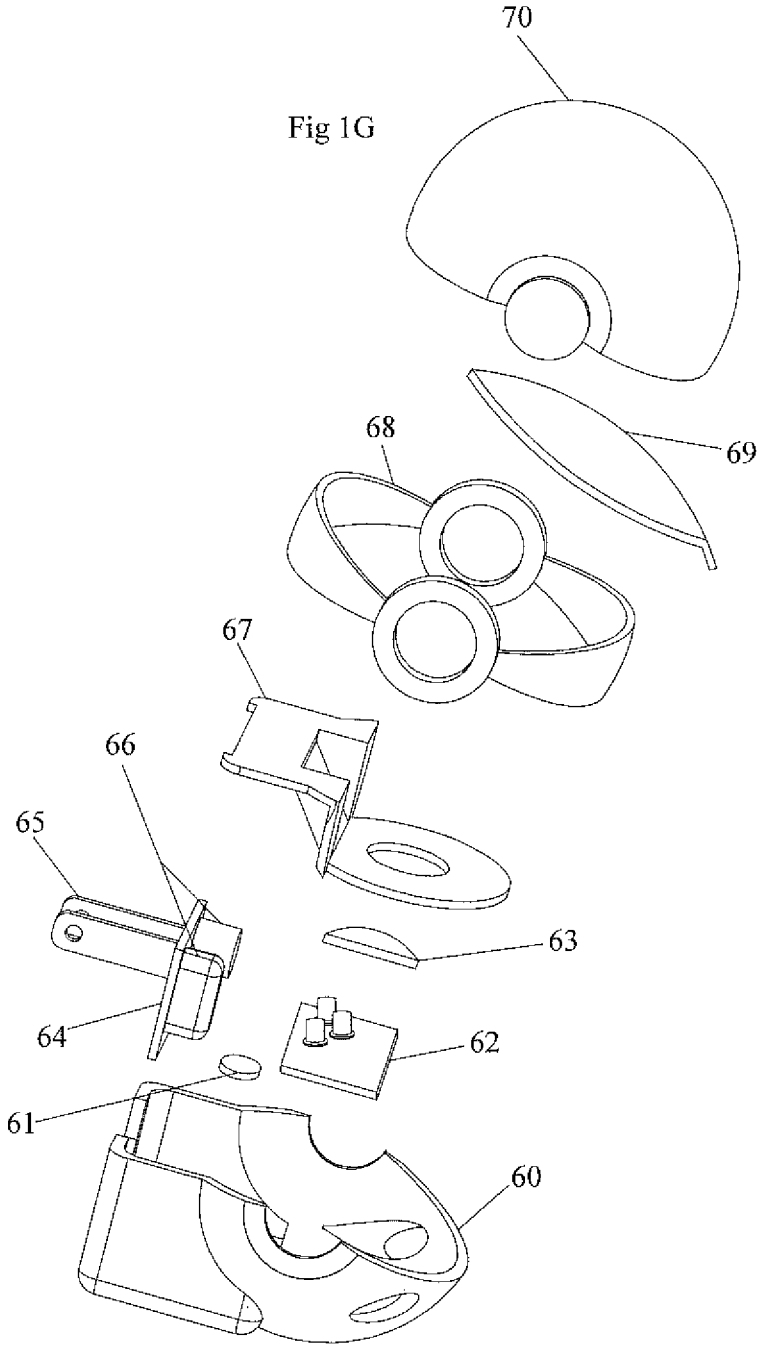
FIG. 1G shows a detailed construction of the embodiment of FIGS. 1C to 1F.

FIG. 1G shows an exploded view of a light device corresponding to the one shown in FIGS. 1C to 1F, including (as described in text boxes in the original drawings) an outside optics means 70, inner optics lens 69, a middle base 56 to which the first optics means 70 is pivotably coupled, a PCB cover and inner lens installation bracket 67 to prevent persons from touching electrical parts and accessories housing in a main base 60, a PCT with LEDs 62 and an LED cover 63 with desired texture, a CDS or other sensor means 61 in the form of a switch, motion sensor, remote, Bluetooth receiver, infrared sensor, or other control means, a power supply circuit 64 and a prong means 65. Alternatively, the light device of FIGS. 1C to 2G may include a direct current (DC) power unit which can have power from any direct current device such as batteries, energy storage means, solar power, wind power, or chemical power.

It will be appreciated that interchangeable AC and DC power sources may also be utilized as described in the inventor's U.S. Pat. No. 8,434,927.

FIGS. 2 and 2A show two preferred optics means having a plurality of different sizes, shapes, thicknesses, focus, and/or color optics lenses in one piece to cause light beams traveling or passing therethrough to hit at least one other optic means having desired optics properties and which may include an optics lens, convex lens, concave lens, reflective lens, refractive lens, moving optic means, and/or light-blocking means with holes, openings, windows, cutouts, stencils, or optic texture lens to create the splendid light performance, effects, functions.

Figure 2B:
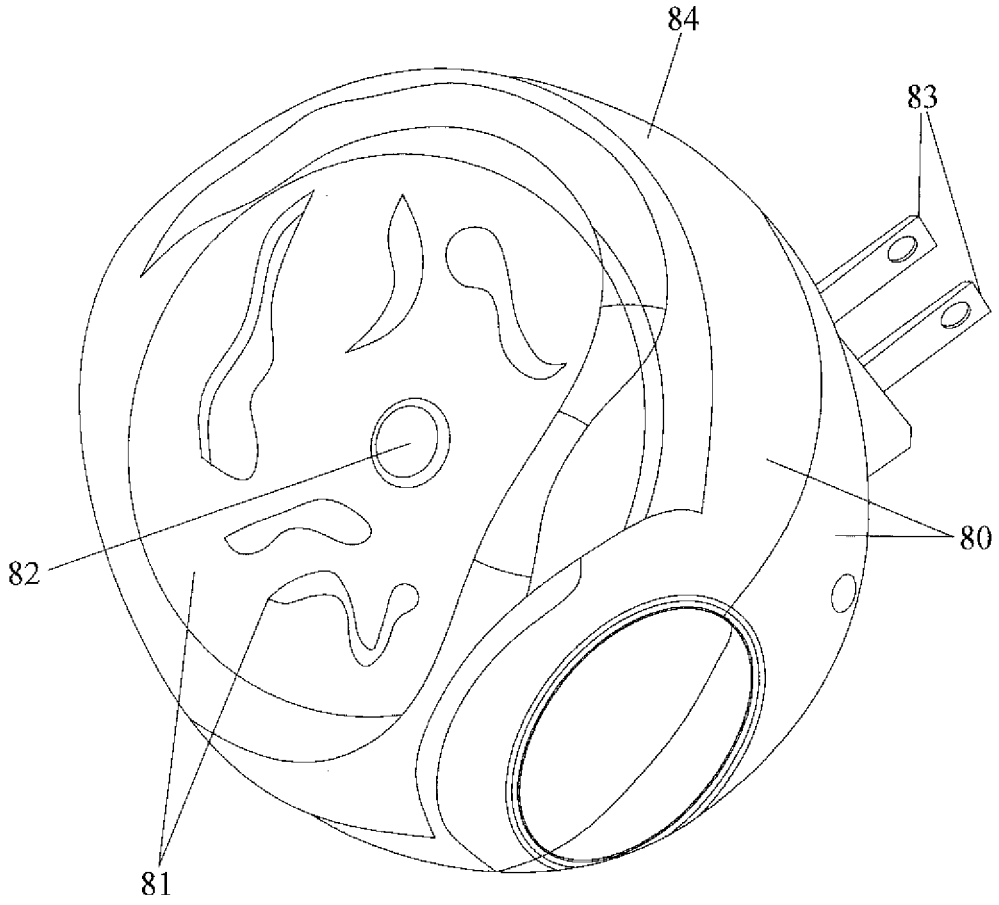
FIGS. 2B, 2C, 2D, 2E, and 2F show another preferred embodiment which is the same as that shown in FIG. 1A but adds moving optics means or moving light source means, the optics means having shaped openings, cutouts, holes, stencils, or windows to allow light beams to pass through the light-blocking means and through the top wide angle viewing angle cover, which has its preferred optics textures, thickness, convex or concave lens properties, or reflective or refraction optics properties to allow an image, message, time, geometric art, nature scene, galaxy, milky way, sky, cloud, stars, moon, water waves, animal, characters, cartoon, sign, logo, commercial to been seen. This embodiment incorporates a motor/movement/spin/rotating/moving/magnetic unit and coil means to cause the optics means or light source to become a moving type optics means to achieve motion light effects. This will increase the value of the current invention.

As shown in FIG. 2B, the more than one optics means 81,84 and LEDs and/or Laser-lights may also be incorporated with other electric parts and accessories such as a power source, circuit means, motor means, movement means, spin means, rotating means, magnetic unit and coil means, IC means, sensor means, control means, conductive means, prong means, USB means, and any other electric parts and accessories that enable the light device to provide a predetermined light function. The LEDs and other parts and accessories are all mounted on a holder 82 having an axis connected to a motor (now shown) for rotation within a base 80. Power may be supplied by a prong means 83.

Figure 2C:
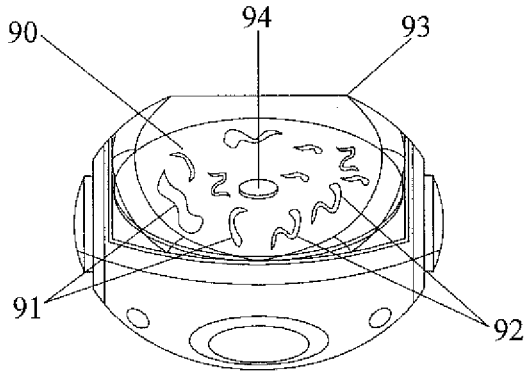
Figure 2D:
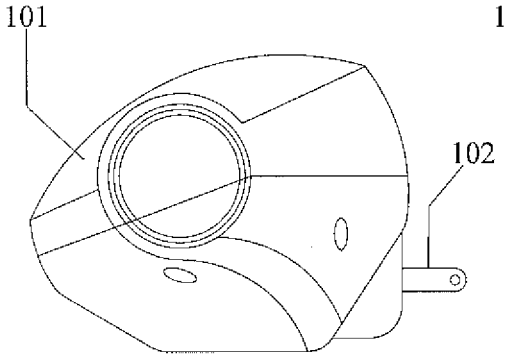
Figure 2E:
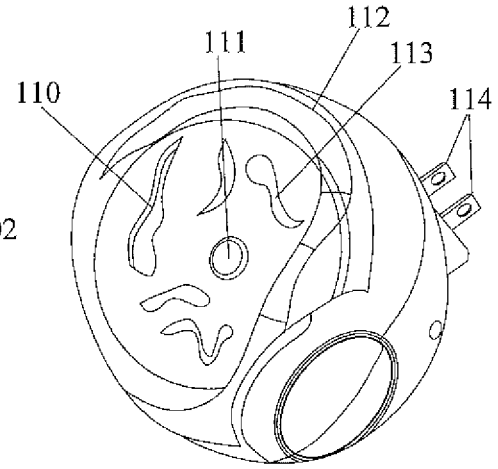

FIGS. 2C to 2E show details of a preferred embodiment that includes a first top cover optics means 93,100,112, a second optics means 90,110 including shaped openings, cutouts, or holes 91,92,110120,121 to permit passage of light emitted by LEDs (not shown), holder means 94,111, 122 to permit movement of the second optics means 90,110 relative to base 123, and prong means 102 for supplying power to a motor or the LEDs.

Figure 2F:
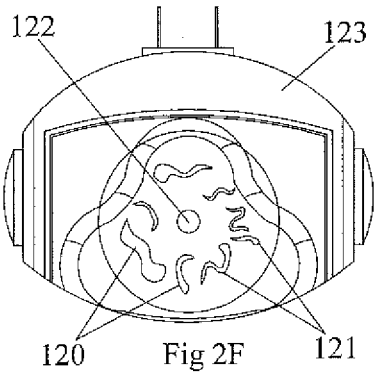
Figure 2G:
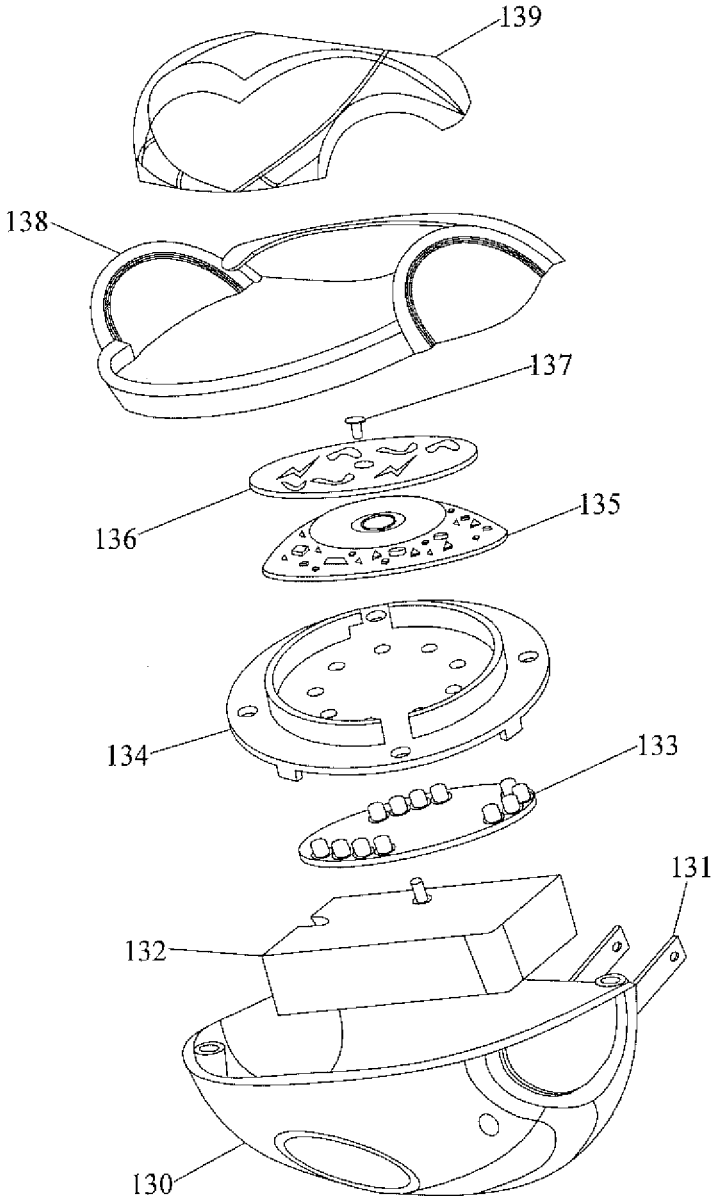
FIG. 2G shows the detailed construction of the embodiment of FIGS. 2 and 2A to 2F.

FIG. 2F shows a variation of the preferred embodiment of FIGS. 2C to 2E, including first top cover optics means 139 supported on an upper base 138, a second optics means 136 and a third optics means 135, each including shaped openings, cutouts, or holes to permit passage of light emitted by LEDs 133, holder means 137 for mounting the second optics means 136 and third optics means 135 on a tray 134 connected to motor 132 to cause movement of the second and third optics means relative to base 130, and prong means 131 for supplying power to a the motor 132 and LED 133.

Figure 3A:
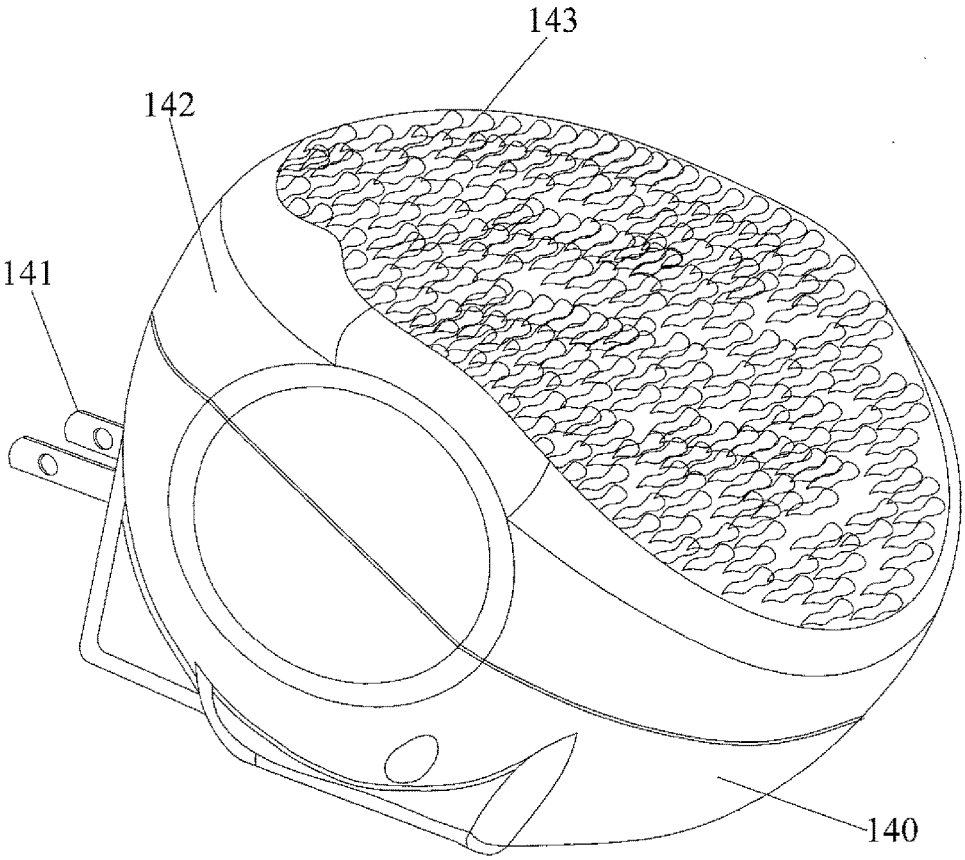
FIG. 3A shows a preferred embodiment again having more than one optics means including a top wide viewing angle optic-means cover which has wave-like textures with a variety of thicknesses so as to provide variable focus when the LED and/or laser light beams hit the cover, some of the light beams reflecting and some of the light beams refracting to the viewer. A second inner optics means may be provided, which may be a moving optic-means connected with a motor or magnetic unit and coil means to cause a waving or other motion of the moving optic-means so that light beams traveling or passing through the inner moving optics means will change position, direction, or orientation and hit the top cover's optic designs to achieve more splendid light effects, including any combination selected from an image, message, time, geometric art, nature scene, galaxy, milky way, sky, cloud, stars, moon, water waves, animal, characters, cartoon, sign, logo, or commercial.

FIG. 3A shows yet another preferred embodiment including an upper housing 142 fixed to a lower housing 143, prong means 141, and a top optics means with a water wave texture having varying thickness so as to provide both reflective and refractive effects before allowing light to pass to a viewer.

Figure 3B:
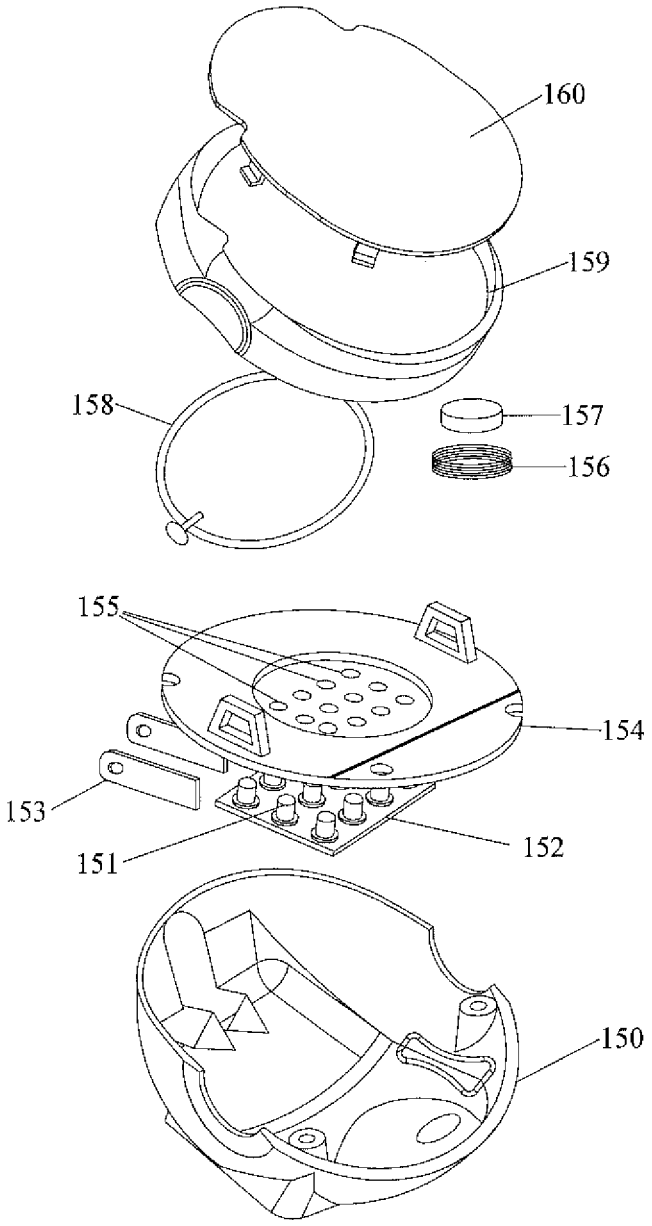
FIG. 3B shows the detailed construction of the embodiment of FIG. 3A.

FIG. 3B shows further details of the preferred embodiment of FIG. 3A, including first optics means 160 in the top cover, second optics means 158 with a wave texture or varying thickness and connected to moving means such as a magnetic unit 157 and coil 156 attached to a tray 154 that holds the second optics means during movement caused by the interaction between magnetic unit 157 and coil 156, the tray 154 including openings 155 to permit passage of light from LEDs 151 mounted on circuit board 152, which is mounted in the base 150.

FIGS. 1, 1A, and 1B show a plug-in type light device with a base installed on the plug-in device housing to provide AC power to drive the LEDs and/or laser light by an inner circuit means that includes any of a sensor means, switch means, control means, and optional motor means to provide a moving optics means that ensures that the image projected onto a ceiling, wall, or floor has plenty of color and motion (in case a motor means is provided).

The geometrically shaped optics-means has more than one reflection or refraction means which, as shown in FIGS. 1, 1A, and 1B, may be in the form of a sphere or ball top cover optics-means having a plurality of optics lenses with desired optics properties, including magnification and diffusion or spreading out of the light beams reflected or refracted by mirror-polished interior or exterior reflection or refraction means, or by optics means having a round convex exterior surface that forms a convex-lens. Not only can the optics means reflect the light beams, but it also can allow light beam refraction and transmission to wider areas.

It will be appreciated that the AC type power unit may include a receptacle (not shown) to receive the transformer, adaptor or AC wires that supply power to cause the light source(s) to turn on and emit light beam to desire area(s). Power can also be supplied by a USB wire to get power from USB ports, as is known to those skilled in the art.

FIGS. 1, 1A, and 1B show that the optic means has more than one reflective or refractive surface to allow light beams to travel or pass through the convex-lens of the top cover optics means and reflect within the reflective-lens or refract to emit light and create an image on a ceiling, wall, or floor.

FIG. 2F shows the inner construction of a preferred the light device having built-in motor means (or equivalent motor means as described above) fixed in the housing may by a screw means. A gear-set means (not shown, but inside the motor means box) may be provided to reduce the motor's rotating speed to a slower speed to prevent the image on the ceiling, wall, or floor from moving to rapidly, which would make people uncomfortable. Additional parts and accessories (not shown) that may be provided include a switch means and conductive wires to connect with circuit means and the power source.

Figure 4:
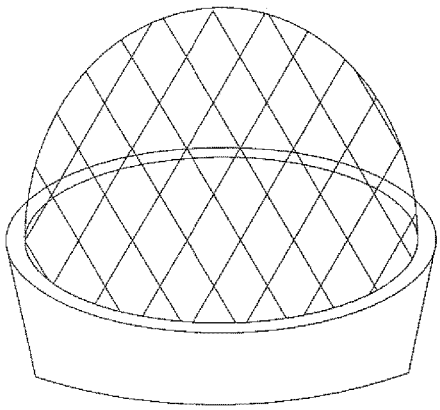
FIGS. 4, 4A and 4B show an alternative design of a top cover optic means having a plurality of reflective and refractive optics lenses to cause light beams to travel back and forth within the top cover, which has a ball shape to cause the light beams to spread out and obtain an image having a wide range and big size.

Alternative designs for the top cover with convex lens features will still fall within the current invention scope, such as the one shown in FIG. 4, in which light beams reflect within more than one reflection-means on an inner side of optics-means in the shape of a sphere. The light beams also pass through an outside convex-lens to project the image to the ceiling, wall, or floor. This embodiment thus includes more than one reflection-means in the optics-means, light projection though the more than one optics-means, the inner side of which is a flat mirror-polished reflector and the outer side of which has a convex-shape to form convex-lenses, the convex lenses together forming a semi-spherically shaped half of a spherical structure.

Figure 4A:
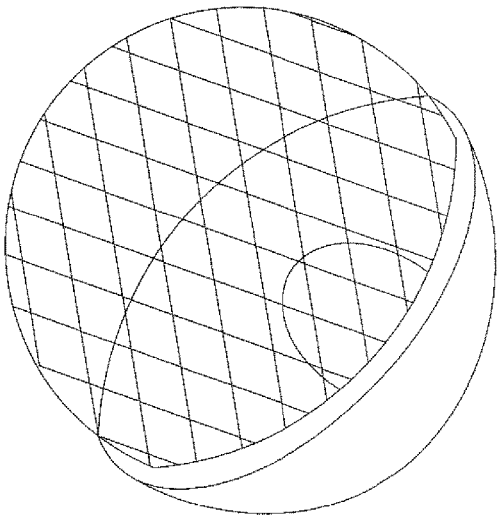

Another alternative design for a top cover with convex lens features is shown in FIG. 4A, which shown two half-spheres with a base to form the optics-means. Each one of the optic-means has more than one reflection-means to form the half-sphere geometric ball. This arrangement may use concepts described in the inventor's earlier U.S. Pat. No. 7,632,004, which describes an LED night light base with more than one optics means, U.S. Pat. No. 8,277,087, which describes an arrangement having more than one reflect means; U.S. Pat. No. 7,455,444, which describes an LED night light having more than one LED; and U.S. Pat. No. 8,434,927, which describes interchange power sources.

Figure 4B:
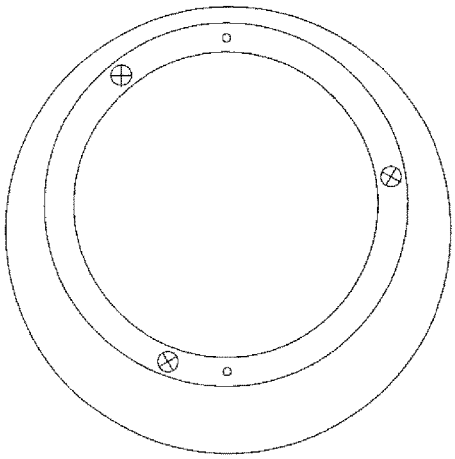

Yet another alternative design for a top cover with convex lens features is shown in FIG. 4B, which shows two optics-means having more than one reflection-means inside each of optics-means to overcome the LED's narrow light beam angle. The current invention may utilize LEDs that emit light beams in different directions to the reflection-means so that even if the light angle is narrow, it is not a problem because the light emitted from the LEDs will hit the first reflect-means, then hit the second, third, fourth, and so forth reflection-means until 100% of the light beams has passed through the convex-lens. If a motor is added, then the image can be rotated so that the viewer sees a moving image.

FIG. 4, 4A, 4B implement by alternative designs the principle of a ball-shaped top cover optic means having a plurality of reflective and refractive optics lens designs so as to cause light beams to travel back and forth within the top cover and cause the light beams to spread out in order to achieve an image having a wide range and big size.

In the preferred embodiments, images are created based on the relationship between the first optics means and the second optics means or all other optics means. The light device can employ any kind of design, shape, display, or geometric arrangement of the more than one optics means to create a big size or large image to cover a big area for special light effects.

Although specific preferred embodiments of the current invention are described above, it is to be appreciated that all alternative, equivalent, same-function and/or same-skill-or-theory variations, modifications, replacements, arrangements, or constructions may still fall within the current scope of the invention.

The invention claimed is:

1. An LED and/or laser light device having more than one optical element to create a wider viewing angle image comprising:

at least one LED and/or laser light; and more than one optical element having a geometric shape, each said optical element having reflective and/or refractive properties, wherein the more than one optical element includes at least one first optical element arranged to reflect, refract, enlarge, shape, and/or diffuse light beams from the at least one LED and/or laser light and at least one second optical element arranged to reflect, refract, enlarge, shape, and/or diffuse an image formed by the light beams from the first optical element, wherein light beams emitted by the at least one LED and/or laser light are reflected and/or refracted by the at least one first optical element before traveling or passing through the at least one second optical element to create a wider range or bigger size of image for projection to at least one external surface, said external surface including a ceiling, wall, or other surface, wherein the at least one LED or laser light is selected from any combination of a single color, multiple color, multiple piece, standard, and special LED or laser light assembly, the at least one LED or laser light having a predetermined spacing or distance, position, or orientation to obtain desired light effects, wherein said at least one LED and/or laser light is connected to a power source by conductors and circuitry including means that cause said at least one LED and/or laser light to turn on and off for a predetermined period to provide predetermined functions, colors, and effects, wherein said image includes at least one of a message, lighted pattern, time, geometric art, nature scene, galaxy, milky way, sky, cloud, stars, moon, water waves, aurora light, animal, character, cartoon, sign, logo, and commercial formed by light beams reflected and/or refracted by one of said optical elements and traveling or passing through another of said optical elements, and wherein said LED and/or laser light device is a plug-in outlet device, USB device, or AC outdoor lighting device.

2. An LED and/or laser light device having more than one optical element to create a wider viewing angle image as recited in claim 1, wherein said at least one first optical element is selected from the group consisting of a mirror, chrome-finished piece, fine-polished piece, double-sided mirror, optics lens, light blocking material having a shaped opening, cutouts, holes, windows, and stencil.

3. An LED- and/or laser light device having more than one optical element to create a wider viewing angle image as recited in claim 1, wherein said at least one first optical element and/or said at least one second optical element is selected from at least one of the following types of optical elements:

(1) optical elements having textures;

(2) optical elements having light blocking properties and shaped holes, openings, cutouts, windows, or a stencil;

(3) moving optical elements that incorporate a crank, motor, spin device, rotating device, movement device, or magnet and coil;

(4) optical elements having a plurality of different shapes, sizes, colors, or thicknesses in one piece to cause light beams from at least one fixed LED or laser light to spread out; and (5) optical elements included in a cover having a wide opening to increase a viewing angle and cause all light beams to spread out.

4. An LED and/or laser light device having more than one optical element to create a wider viewing angle image as recited in claim 1, wherein said power source is selected from the group consisting of an outlet, batteries, solar power, chemical power, and wind power or market available energy to provide electricity through related circuit elements to drive said at least one LED or laser light to emit light beams.

5. An LED and/or laser light device having more than one optical element to create a wider viewing angle as recited in claim 1, further comprising a device for moving at least one of the optical elements, the moving device including at least one of a motor, spin device, magnet and coil, moving device, and gear set that fit within the LED and/or laser light device to cause the projected image to move.

6. An LED and/or laser light device having more than one optical element to create a wider viewing angle image as recited in claim 1, wherein said LED and/or laser light device is selected from a single or multiple color light device, a multiple piece light device, a standard unit, and a custom made assembly.

7. An LED and/or laser light device having more than one optical element to create a wider viewing angle image as recited in claim 1, wherein said LED and/or laser light device is pluggable into (1) a plug-in wall outlet, receptacle, extension cord, power strip or cigarette lighter, or (2) a USB power device.

8. An LED and/or laser light device having more than one optical element to create as recited in claim 1, wherein said at least one first optical element and/or said at least one second optical element is selected from at least one of a light-transmitting lens, refractive lens, convex lens, concave lens, laser lens, reflector, film, hologram lens with preferred texture, lens with a polish finished surface, lens with a variety of thicknesses or foci, and a plurality of tiny optics elements combined into one piece.

9. An LED and/or laser light device having more than one optical element to create a wider viewing angle image, comprising:

a plurality of LEDs and/or laser light sources; and more than one optical element having a geometric shape, said optical elements each having a surface having reflective and/or refractive optics-properties, wherein the more than one optical element includes at least one first optical element arranged to reflect, refract, enlarge, shape, and/or diffuse light beams from the at least one LED and/or laser light and at least one second optical element arranged to reflect, refract, enlarge, shape, and/or diffuse an image formed by the light beams from the first optical element; and wherein said at least one first optical element reflects and/or refracts light beams before they travel or pass through at least one second optical element to create a wider range or bigger size of image for projection onto a ceiling, wall, or other surface while connected to a USB device, plugged into an outlet or extension cord, or connected with an AC power source by prong means, USB means, wire means, adaptor means, or transformer means with or without a wire, wherein the plurality of LEDs and/or laser light sources selected from any combination of a single color, multiple color, multiple piece, standard, and special LEDs and/or laser light sources, the plurality of LEDs and/or laser light sources having a predetermined spacing, distance, or orientation, wherein said plurality of LEDs and/or laser light sources are connected to a power source by conductors and circuitry including means for causing said plurality of LEDs and/or laser light sources to turn on and off for a predetermined period to provide predetermined functions, colors, and effects, wherein said image includes at least one of a message, lighted patterns, time, geometric art, nature scene, galaxy, milky way, sky, cloud, stars, moon, water waves, aurora light, animal, character, cartoon, sign, logo, and commercial formed by light beams reflected and/or refracted by one of said optical elements and traveling or passing through another of said optical elements, and wherein image moving effects are created without a motor by causing said plurality of LEDs and/or laser light sources to sequentially flash, fade-in and fade-out, change colors, randomly turn on and off, or exhibit other LED light performances, effects, duration, or duty cycles to cause a viewed image to appear to be moving.

10. An LED and/or light device having more than one optical element to create a wider viewing angle or larger size image comprising:

at least one LED and/or laser light; and more than one optical element having a geometric shape, said optical elements each having a surface having reflective or refractive optics-properties, wherein the more than one optical element includes at least one first optical element arranged to reflect, refract, enlarge, shape, and/or diffuse light beams from the at least one LED and/or laser light and at least one second optical element arranged to reflect, refract, enlarge, shape, and/or diffuse an image formed by the light beams from the first optical element;

wherein said at least one first optical element reflects and/or refracts light beams before they travel or pass through at least one second optical element to create a wider range or bigger size of image for projection onto a ceiling, wall, or other surface while connected to a USB device, plugged into an outlet or extension cord, or connected with an AC power source by prong means, USB means, wire means, adaptor means, or transformer means with or without a wire, wherein the at least one LED and/or laser light is selected from any combination of a single color, multiple color, multiple piece, standard, and special LEDs, the plurality of LEDs having a predetermined spacing, distance, position or orientation, wherein said at least one LED and/or laser light connected to a power source by conductors and circuitry that cause said at least one LED or laser light to turn on and off for a predetermined period to provide predetermined functions, colors, and effects, wherein said image includes at least one of a message, time, lighted patterns, geometric art, nature scene, galaxy, milky way, sky, cloud, stars, moon, water waves, aurora light, animal, character, cartoon, sign, logo, and commercial formed by light beams reflected and/or refracted by the at least one first optical element and traveling or passing through the at least one second optical element, said at least one first optical element being a moving optical element driven by at least one of a motor, spin device, rotating device, magnet and magnetic coil, and movement device, wherein said moving optical element is made of a light block-out material with shaped openings, cutouts, windows, or a stencil, and wherein the moving optical element has a predetermined optical texture or desired shape with a variety or plurality of different thicknesses to allow light passing through to create said moving image, wherein said LED and/or laser light device is a plug-in outlet device, USB device, or AC outdoor lighting device.

* * * * *